United States Patent [19]

Nishikawa

[11] 4,391,502

[45] Jul. 5, 1983

[54] ELECTROPHOTOGRAPHIC APPARATUS HAVING MEANS FOR ADJUSTING THE REPRODUCTION PROPERTIES OF SUBSEQUENT COPIES AFTER A FIRST COPY HAS BEEN PRODUCED

[75] Inventor: Masaji Nishikawa, Hachioji, Japan

[73] Assignee: Olympus Optical Company Limited, Tokyo, Japan

[21] Appl. No.: 191,356

[22] Filed: Sep. 26, 1980

Related U.S. Application Data

[63] Continuation of Ser. No. 940,657, Sep. 8, 1978, abandoned.

[30] Foreign Application Priority Data

Sep. 12, 1977 [JP] Japan ..... 52-108909

[51] Int. Cl.[3] ..... G03G 15/00

[52] U.S. Cl. ..... 355/3 DD; 355/14 E; 355/14 D; 355/67

[58] Field of Search ..... 355/3 DD, 3 SC, 3 R, 355/67–71, 14 E, 14 D; 118/647–651; 430/31

[56] References Cited

U.S. PATENT DOCUMENTS

| | | | |
|---|---|---|---|
| 3,281,241 | 10/1966 | Mihajlov | 96/1 R |
| 3,349,221 | 10/1967 | Schulze et al. | 355/3 R |
| 3,677,632 | 7/1972 | MacDonald | 355/3 R |
| 4,035,069 | 7/1977 | Yano | 355/3 DD |
| 4,046,466 | 9/1977 | Ando et al. | 355/3 SC |
| 4,080,057 | 3/1978 | Nakane et al. | 355/3 R |
| 4,095,884 | 6/1978 | Okamoto et al. | 355/3 R |

*Primary Examiner*—R. L. Moses

*Attorney, Agent, or Firm*—Fleit, Jacobson & Cohn

[57] ABSTRACT

An electrophotographic process for forming or printing one or more duplicated copies of an original document comprises a step for subjecting a uniformly charged photosensitive member such as a photoconductive drum and a photoconductive screen drum to an imagewise exposure corresponding to an image of the document to be duplicated to form an electrostatic charge latent image corresponding to the image of the document;

a step for developing the electrostatic charge latent image with a toner developer such as a magnetic brush by bringing it into contact with the latent image while applying a development bias voltage between the photosensitive member an a development electrode arranged at or near development means; and a step for transferring the developed toner image onto a record medium to form the duplicated image thereon, wherein the development bias voltage is manually changed to adjust a quality of the toner image such as density, contrast and half tone properties. In a preferred embodiment of the invention an amount of the imagewise exposure is also made manually adjustable.

2 Claims, 8 Drawing Figures

ELECTROPHOTOGRAPHIC APPARATUS HAVING MEANS FOR ADJUSTING THE REPRODUCTION PROPERTIES OF SUBSEQUENT COPIES AFTER A FIRST COPY HAS BEEN PRODUCED

This is a continuation of application Ser. No. 940,657 filed Sept. 8, 1978 abandoned.

BACKGROUND OF THE INVENTION

This invention relates to an electrophotographic process and an apparatus for printing or duplicating one or more copies by carrying out the electrophotographic process.

The prior art electrophotographic process may be classified into the following two types: one for obtaining one duplicated copy with a single imagewise exposure (hereinafter referred as single imagewise exposure-single copy type) and the other for obtaining a plurality of duplicated copies on the basis of a single and same image information once formed by a single imagewise exposure (hereinafter referred as single imagewise exposure-multiple copy type). The latter type of electrophotographic process is described, for example, in U.S. Pat. Nos. 2,951,443, 3,598,580 and 3,627,523. According to these processes, the development and transfer steps are successively repeated for an electrostatic charge image once formed on a charge retentive member without destroying the charge image so as to form the same image on a plurality of image receiving papers. Another process which belong to said latter type of electrophotographic method is described in U.S. Pat. Nos. 2,756,676 and 3,713,734. According to the process described in said U.S. Pat. No. 2,756,676, in order to obtain a plurality of duplicated copies a toner image developed on the charge retentive member is partially left upon transferring the toner image onto the record medium and then steps of uniform charging, uniform exposure, development and partial transfer are repeated successively. That is, a plurality of copies are formed on the basis of the residual toner image after transfer. According to the process described in said U.S. Pat. No. 3,713,734 use is made of a photoconductive screen and a flow of corona ions are repeatedly modulated on the basis of an electrostatic latent image formed on the photoconductive screen so as to obtain a plurality of duplicated copies.

Further, in the electrophotographic art various techniques for changing a development density and a half tone reproduction property of a duplicated copy image have been developed and some of them are practically used. According to the most commonly used technique for changing the development density of the copy image an input signal energy such as an amount of image projection light for forming an electrostatic latent image corresponding to an original image on the charge retentive member is controlled. This method can be effectively applied to said electrophotographic apparatus of single imagewise exposure-single copy type, but can not be applied to said electrophotographic process of single imagewise exposure-multiple copy type. That is, in case of forming a plurality of duplicated copies of a single and same original by means of the former process when a first copy having an incorrect development density is obtained, said input signal energy such as an amount of imagewise exposure light can be suitably adjusted so as to obtain the subsequent copies having a desired density. On the contrary, in case of the latter process namely the electrophotographic process of single imagewise exposure-multiple copy type, when the development density of the first duplicated copy is not correct, the input signal energy for producing the electrostatic latent image could not be corrected during the process for printing the subsequent copies, because in this process the input signal energy is not applied after the first duplication. Therefore, in this case all of the copies obtained might have an incorrect density.

As the technique for adjusting the half tone reproducibility it has been proposed to decrease or increase an initial potential uniformly charged on the charge retentive member so as to decrease or increase an electrostatic contrast of the electrostatic charge latent image formed thereon. This method may be applied to an electrophotographic apparatus having a particularly high electrostatic contrast for obtaining a copy image having a low contrast such as a photographic image. However, in this method, since the uniformly charged potential is made low the highest density of the duplicated copy is also limited to a low value and further if in order to lower the uniform charging potential the corona voltage applied to a corona charging device is lowered, the corona charging becomes unstable and thus a non-uniform charging might be produced, which causes an uneveness in the developed image.

Then, the inventor has proposed in Japanese Patent Application No. 104,223/76 an electrophotographic apparatus which can change the density and the half tone reproduction property of successive duplicated images. This electrophotographic apparatus makes use of, as the the charge retentive member a photosensitive screen composed of an insulating layer, two electrically conductive layers coated on opposite surfaces of the insulating layer and a photosensitive layer coated on one of the electrically conductive layers and is so constructed that a bias voltage applied between said two electrically conductive layers can be controlled from the outside so as to adjust the density and the half tone reproduction property of the successive picture images. However this technique can be only applied effectively to the electrophotographic apparatus comprising the photosensitive screen having the two electrically layers but can not be applied to the electrophotographic apparatus comprising the charge retentive member other than the photosensitive screen or a photosensitive screen having only one electrically conductive layer.

SUMMARY OF THE INVENTION

An object of the invention, therefore, is to solve the above mentioned problems and to provide an electrophotographic process which can adjust a density and/or a half tone reproduction property of successive duplicated picture images by manual operations.

It is another object of the invention to provide an electrophotographic process in which the density, contrast and/or half-tone property can be manually adjusted without changing input signal energy.

It is still another object of the invention to provide an electrophotographic process wherein the half-tone reproducibility can be manually altered without lowering a uniformly charged potential on a charge retentive member.

Still another object of the invention is to provide an improved electrophotographic process in which the density control can be made low at will to improve the half-tone reproducibility without decreasing the highest density.

It is still another object of the invention to provide an electrophotographic process for printing a plurality of copies from the same and single charge latent image once formed on a charge retentive member wherein the density, contrast and/or half-tone reproducibility may be manually adjusted during a multiple copying operation.

An electrophotographic process according to the invention comprises a step of forming an electrostatic charge latent image on a charge retentive member and a step of developing the latent image with toners while applying a development bias voltage which can be manually selected between said charge retentive member and a development electrode, whereby a quality of a duplicated picture image can be adjusted at will.

The invention further provides an electrophotographic apparatus comprising means for projecting an optical image of an original onto a charge retentive member to produce thereon an electrostatic latent image corresponding to the original to be duplicated, means for developing the latent image with toners, and means provided on a housing for adjusting a development bias voltage applied across said charge retentive member and a development electrode; whereby a quality of the reproduced picture image can be adjusted at will by means of said adjusting means.

In a preferred embodiment of the electrophotographic apparatus according to the invention means for adjusting an amount of light for said optical image projection are provided on the housing of the apparatus in manually operable manner, whereby a quality of the duplicated picture image can be adjusted at will by means of said adjusting means.

DESCRIPTION OF THE PREFERRED EMBODIMENTS

Figure 1:
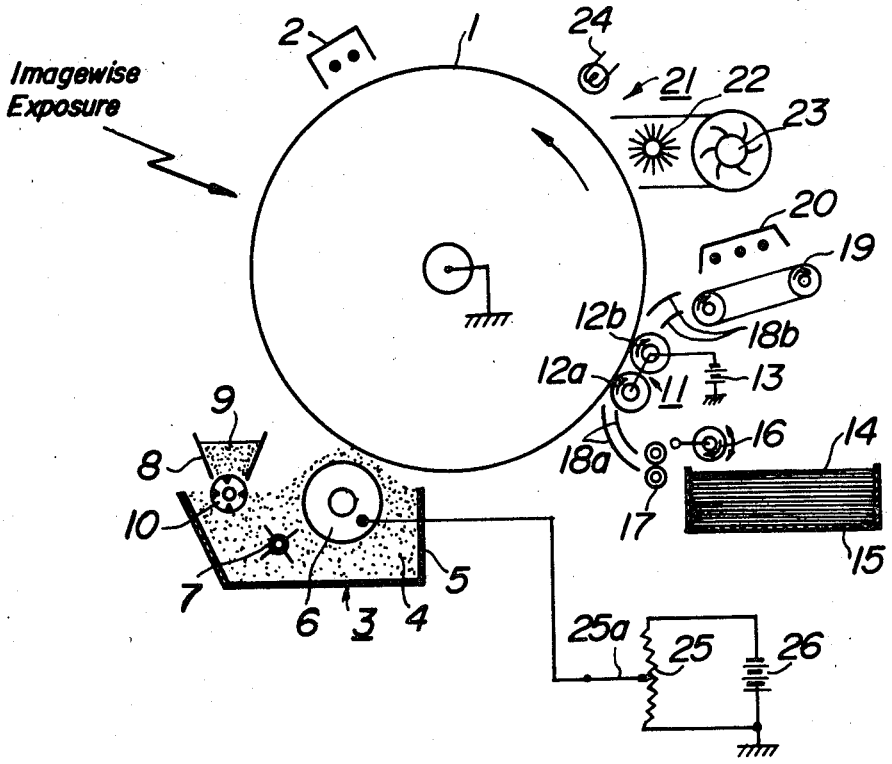
FIG. 1 is a diagrammatic view showing a construction of an electrophotographic apparatus according to the invention.

FIG. 1 shows diagrammatically an embodiment of an electrophotographic apparatus according to the invention. In this embodiment, as a charge retentive member use is made of a photoconductive drum 1 which comprises an electrically conductive metal drum, a thin layer of inorganic photoconductive material such as Se, Se-alloy, ZnO, Se-Te etc. applied on the drum and a layer of organic photoconductive material such as PVK etc. or a layer of organic photoconductive material containing a sensitizer applied on the inorganic photoconductive thin layer. The photoconductive drum 1 is rotatable in a direction as shown by an arrow. The drum 1, at first, is uniformly charged in either positive or negative by a corona charging device 2. In this embodiment the drum is charged in negative polarity. The drum 1 thus uniformly charged is then illuminated with a light image corresponding to an original image to form on the drum 1 an electrostatic charge latent image corresponding to the light image. The latent image is then passed through a development device 3 in which the laten image is developed with toners to a visual image.

The development device 3 makes use of a magnetic brush development method. A dry particulate developer 4 which consists of a mixture of electrically insulating toners and magnetic carrier particles and is contained in a development vessel 5 is transported by means of a magnetic roller 6 and brought in contact with the surface of the drum 1, as a result of which the latent image on the drum 1 is visualized as a toner image. An agitator vane 7 serves to sweep up the toners on the magnetic roller 6 and to uniformely mix the toner particles with the magnetic carrier particles in the vessel 5. The toners are contained in a hopper 8 and is supplied into the vessel 5 through the open end of the hopper at which end a rotating knurled roller 10 is arranged. Therefore, if the rotation of the knurled roller 10 is controlled in accordance with a concentration of toners in the developer, the concentration can be maintained constant.

The toner image developed on the photoconductive drum 1 is then passed through an image transfer device 11 wherein the toner image is transferred onto a record paper. The image transfer device comprises a pair of transfer rollers **12*a* and 12*b* which are spaced apart from each other and arranged in close to or in contact with the drum 1 and a transfer bias voltage source 13 for applying a bias voltage to the transfer rollers 12*a* and 12*b*. The transfer rollers 12*a* and 12*b* serve to bring the record paper into contact with the surface of the photoconductive drum 1 in tight manner and to apply the transfer voltage to the rear surface of the record paper. Thus, the transfer rollers 12*a*, 12*b* are preferably formed by electrically conductive or semiconductive and mechanically resilient rollers. If necessary, three or more transfer rollers may be arranged. The voltage value of the transfer bias voltage source 13 is selected so that during the transfer step a destruction of the latent image caused by an undesired discharge to the photoconductive drum and a migration of charge could not occur. If the transfer rollers 12*a*, 12*b*** are formed by a relatively high conductive material such as conductive rubber etc., said voltage value is lower than 500 V and if the transfer rollers are formed by conductive rubber rollers having an insulating layer coated thereon, said voltage value is higher than 500 V so that the voltage actually applied to the rear surface of the record paper becomes lower than 500 V.

The record papers 14 are stuck in a cassette 15 and are drawn out one by one by means of a paper supply roller 16 in synchronism with the rotation of the photoconductive drum 1 and passed between the drum 1 and the transfer rollers **12*a* and 12*b* through a pair of paper feed rollers 17 and a paper guide 18. During the paper passing between the drum 1 and the transfer rollers the transfer of the toner image developed on the drum 1 onto the paper is effected. The paper on which the toner image has been transferred is torn off from the drum 1 and passed through a paper guide 18*b* onto a conveyer belt 19. The paper is transported by the conveyer belt 19 and then heated by means of a heater 20** so that the toner is fused and fixed on the paper to form a final image, thereafter the paper is discharged on a tray (not shown).

After the toner image has been transferred, the residual latent image and the residual toners on the photoconductive drum 1 are removed by means of a cleaning device 21 and thus a preparation for a next latent image formation is effected. The cleaning device 21 comprises a cleaning brush 22 for removing the residual toners on the drum 1, a suction fan 23 for sucking the removed residual toners and an erasing lamp 24 for erasing photoelectrically the residual latent image on the drum 1. Instead of or together with the erasing lamp 24 an A.C. corona charging device may be used to erase the latent image.

When a plurality of duplicated copies are to be formed from a single and same latent image once formed on the photoconductive drum 1, after the first transfer has been made the operations of the cleaning device 21 and the corona charging device 2 and the projection of the original light image are skipped and only the development and transfer steps are required to be repeated by a given number of times. After the desired number of duplicated copies are obtained, the cleaning device 21 is operated so as to make the apparatus ready for a next document duplication.

According to the present invention, the above mentioned electrophotographic apparatus is provided on its housing with a manual adjusting member for changing a development bias voltage which is applied between the photoconductive drum 1 and a development electrode. To this end, between the development electrode and the photoconductive drum 1 a development bias voltage source 26 is connected through a variable resistor 25 and the variable arm 25*a* of this resistor is so arranged that it can be manually operated from the outside of the housing of the apparatus. In the embodiment shown in FIG. 1, the magnetic roller 6 of the development device 3 is used as the development electrode. If the magnetic roller 6 is surrounded by an electrically conductive sleeve, this conductive sleeve may be used as the developing electrode. Further the development vessel 5, the agitator vane 7 or any conductive member provided in the developer 4 may be used as the development electrode. In these cases the development device 3 is preferably isolated from other parts of the apparatus. The means for applying the variable development voltage may be constructed by, instead of said means comprising the variable resistor 25, a usual D.C. voltage source which can generate a variable output voltage.

In the electrophotographic apparatus shown in FIG. 1, since the development bias voltage can be adjusted at will by operating the variable resistor 25 from the outside of the apparatus housing, particularly during the process for forming a plurality of duplicated copies from a single and same latent image, the operator can adjust the development density, contrast and/or half-tone reproducibility of the successive copies obtained in subsequent to the first duplicated copy while visually observing these properties of the first duplicated copy. This applies also to a case in which a plurality of copies of a single original are formed by carrying out repeatedly the process for forming one copy with a single imagewise exposure.

Moreover, in the electrophotographic apparatus shown in FIG. 1, particularly in case of obtaining a plurality of duplicated copies from a single and same latent image once formed on the drum by a single imagewise exposure, it is preferred to provide further measures for the development device 3 and the record paper 14 so as to avoid a decay or deterioration of the latent image formed on the drum and a formation of fog during the development or transfer step. For example, for the development device 3 provision may be made of a measure for increasing the resistance of the developer 4. This can be achieved by increasing the toner concentration, coating an insulating layer on the magnetic particles, or using as carries insulating resin particles having magnetic powders mixed therewith. In this way, the decay or deterioration of the latent image and the formation of fog during the development step can be effectively prevented. For the record paper 14 provision may be made of a measure for heating and drying the record paper before it is used or immersing the record paper with high resistance agent. In this manner the fog which is liable to appear in a high humidity condition can be effectively prevented.

The inventor has found that the quality of the duplicated copy image can be further improved by adjusting an amount of the imagewise exposure as well as adjusting the development bias voltage.

Figure 2A:
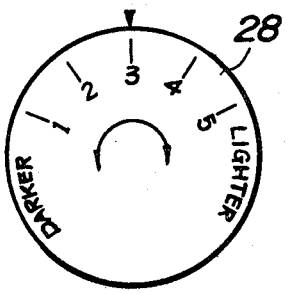
FIGS. 2A and 2B are front and side elevational views of an embodiment of a development bias voltage adjusting means and an exposure adjusting means for use in the electrophotographic apparatus according to the invention.
Figure 2B:
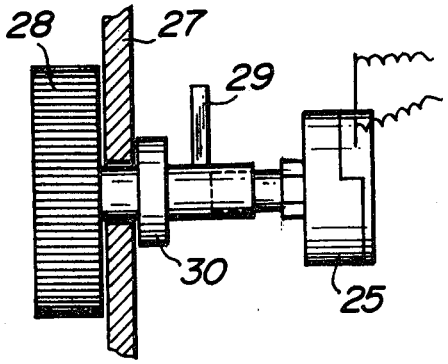

FIGS. 2A and 2B are a front view and a side elevational view of an embodiment of the development bias voltage adjusting means the exposure adjusting means for use in the electrophotographic apparatus according to the invention. In this embodiment, a development density adjusting dial 28 is provided on an operation panel 27 of a housing of the apparatus, and the rotating axis of this dial is connected to the rotating axis of the variable resistor 25 for changing the development bias voltage and is integrally provided with an exposure adjusting lever 29 which drives an adjusting mechanism (not shown) for changing an amount of exposure light, so that the development bias voltage and an amount of imagewise exposure light can be adjusted by rotating the dial 28. Reference numeral 30 is a stopper ring for limiting the rotation of the dial 28. The adjustments of the development bias voltage and the amount of exposure due to the rotation of the dial 28 may be set in such a manner that the development density and the half tone reproduction are adjusted in the same direction, that is in the direction of increasing or decreasing both the density and the half tone reproduction. Of course these adjustments may be in the opposite direction with each other, that is in the direction of increasing or decreasing the density and of decreasing or increasing the half-tone property. The former establishment is commonly used and in this case the erroneous operation can hardly occur. While in the latter establishment, when the amount of exposure is increased, the maximum density might be decreased. However, this can be compensated to some extent by controlling the development bias voltage in the direction of increasing the development density, that is in the direction of decreasing the development threshold potential. Therefore, in this case it is preferred to devise the indications on the dial 28 so as to avoid the erroneous operation. According to the development bias voltage adjusting means and the exposure adjusting means shown in FIG. 2, if these means are applied to the electrophotographic apparatus of single exposure-single copy type, the development density and the half tone reproduction property can be adjusted by rotating the dial 28 for each duplication. Alternatively, if these adjusting means are applied to the electrophotographic apparatus of single exposure-multiple copy type, when the dial 28 is rotated during the multiple duplicating operation only the development bias voltage is changed. Even in this case the development density and the half tone reproduction property of the successive duplicated copies can be adjusted.

Figure 3A:
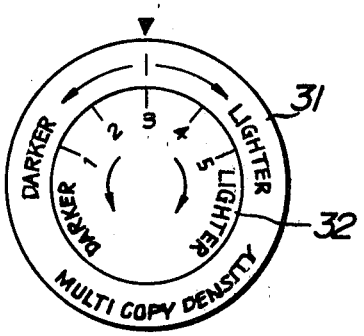
FIGS. 3A and 3B are front and side elevational views of an another embodiment of these adjusting means.
Figure 3B:
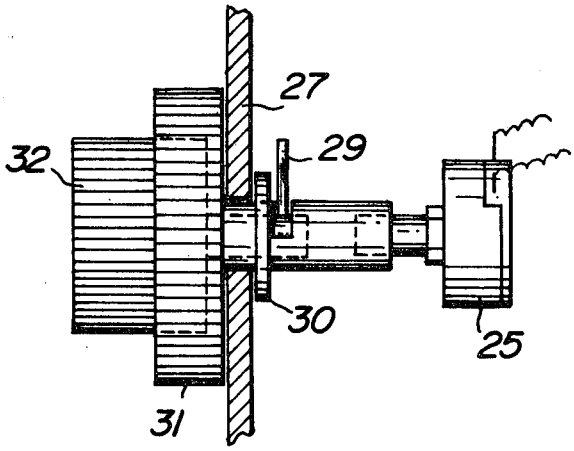

FIGS. 3A and 3B are front and side elevational views of an another embodiment of the development bias voltage adjusting means and the exposure adjustment means for use in the electrophotographic apparatus according to the invention. In this embodiment, a development bias voltage adjusting dial 31 connected to the variable resistor 25 and an exposure adjusting dial 32 which actuates the exposure adjusting lever 29 are arranged coaxially and mounted on the operation panel 27 so that these dials can be operated independently. The directions in rotation of the dials 31 and 32 may be identical with or opposite to the directions in change of the development density and the half tone reproduction property as in FIG. 2. In FIG. 3, the exposure adjusting dial 32 can be adjusted upon the optical image projection, i.e. the formation of electrostatic latent image so as to obtain the desired development density and half tone reproduction property, but the same adjustment can also be achieved by adjusting the development bias voltage adjusting dial 31. If these adjusting means 31 and 32 are applied to the electrophotographic apparatus of single imagewise exposure-multiple copy type only the development bias voltage adjusting dial 31 is effective during the multiple duplicating operation.

Further, in the embodiment shown in FIG. 3 the adjusting means are so arranged that the rotations of the dials 31 and 32 in the same direction cause changes of the development density and the half tone reproduction property which are same in direction and substantially equal in magnitude to each other. Further, the adjusting means are so arranged that the dials 31 and 32 are interlocked by, for example, a friction coupling, while during the image exposure step the development bias voltage adjusting dial 31 is locked by further means to allow only the exposure adjusting dial 32 to be rotated and that if in the electrophotographic appratus of single exposure-multiple copy type and also in the elctrophotographic apparatus of single exposure-single copy type a plurality of duplicated copies of a single and same original are to be obtained, the development bias voltage adjusting dial 31 is released from the locked condition during the multiple duplicating operation. In this case, the development bias voltage dial 31 is further biased by, for example, a spring member so as to return the dial 31 to the original position, while during the multiple duplicating operation a friction force which overrides the return force of the spring is applied to the dial 31 by, for example, a magnetic means. Moreover, at the time when the dial 31 is returned, said friction force applied thereto is removed and at the same time an appropriate friction force is applied to the exposure adjustment mechanism so that this mechanism does not move together with the dial 31.

According to the arrangement described above, the adjustments of the development density and the half tone reproduction property which are effected during the process for forming a plurality of duplicated copies of the single and same original can be reflected on an adjustment for an amount of exposure in a next orginal image exposure, so that the operational capability is improved. Further, during the process of forming a plurality of duplicated copies of a single and same original the adjustments of the density and the half tone of the copies can be effected by operating only the development bias voltage adjusting dial 31, so that the erroneous operation can advantageously be prevented. Then dial 31 may be returned into an initial position by an electromagnetic return mechanism actuated by, for example, a solenoid etc. In this case, during the process of forming a plurality of duplicated copies of a single and same original the return mechanism is deenergized to allow the dial 31 to be rotated in free and when the desired number of copies has been duplicated the return mechanism is energized to return the dial 31 to the initial position. This electromagnetic return mechanism may be used as the means for locking the dial 31 upon the image exposure.

Figure 4A:
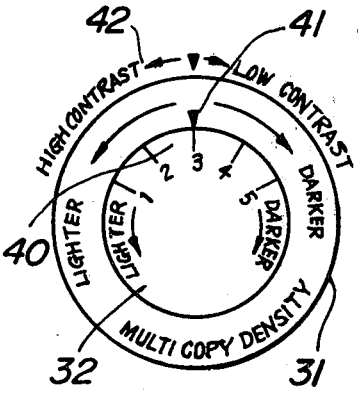
FIGS. 4A and 4B are front and side elevational views of still another embodiment of these adjusting means.
Figure 4B:
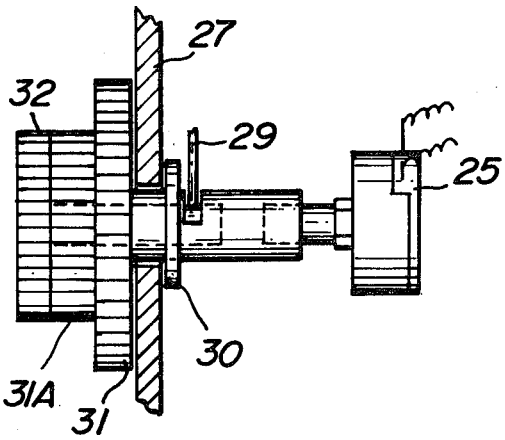

FIGS. 4A and 4B are front and side elevational views of a still another embodiment of the development bias voltage adjusting means and the exposure adjusting means for use in the electrophotographic apparatus according to the invention. The arrangement of this embodiment is substantially same as that of FIG. 3, but in this embodiment the development bias voltage adjusting means and the exposure adjusting means are so arranged that when the dails 31 and 32 are rotated in the same direction, effects of both means on the density and half tone reproduction property, respectively are opposite in direction and equal in magnitude to each other. In this manner, only the half tone reproduction property can be changed without changing the density. The principle thereof will be explained hereinafter with reference to FIG. 5.

Figure 5:
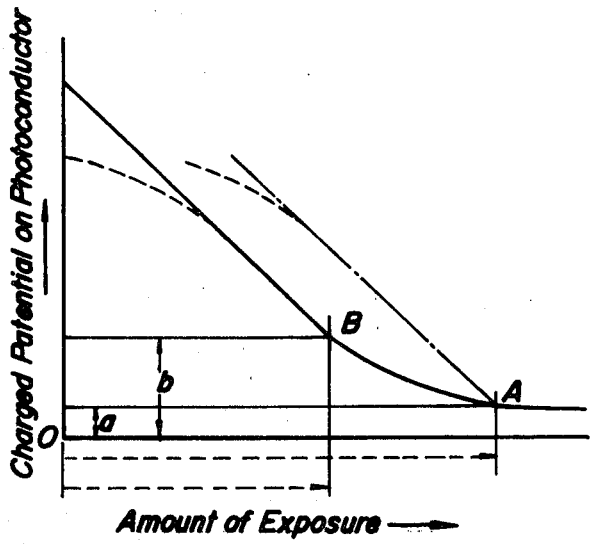
FIG. 5 is a graph showing an exposure-decay characteristic of charged potential on a photoconductor.

FIG. 5 is a graph showing an exposure-decay characteristic of charged potential on a photoconductor, in which an ordinate represents the charged potential on the photoconductor and an abscissa represents an amount of exposure. The charged potential on the photoconductor decays in proportion to the amount of exposure or in accordance with an exponential decay characteristic similar to a discharge characteristic of a capacitor until the amount of exposure increases to a certain value A, the slope of the decay being relatively steep. When the amount of exposure increases over the specific value A, the slope of the decay characteristic of the charged potential gradually decreases and finally the decay ends with a certain residual charged potential. Now, an amount of exposure at a bright area is set to a value which is sufficient to discharge the charged potential to a value near the residual potential, that is point A and the development bias voltage is so set that the potential a at the bright area at this time becomes a development threshold voltage. In this case, the property of the photoconductor can be used in most effective and the greatest number of half tones can be reproduced. Accordingly, this condition is suitable to reproduce an image including a lot of half tone such as photographs. Alternatively, the amount of exposure may be decreased and set so that the amount of exposure at the bright area corresponds to a point B on the steep slope portion of the decay characteristic curve and the development bias voltage may be set so that the potential b on the bright area becomes the development threshold potential. In this case, a portion of the decay characteristic curve having the amount of exposure lower than point B becomes a reproduction region. For comparison, the decay characteristic curve in this case is denoted by a dot and dash line which is shifted to the point A. In this condition, the region of half tone reproduction becomes narrower than that in the first mentioned condition, but the development threshold potential is higher, so that the density contrast of the printed copy becomes higher. Therefore, this condition is suitable to reproduce an image having less half tone such as letters and figures etc. When the latter condition is compared with the former condition, the effective potential on an area having the highest density in the latter condition is lower than that in the former condition. In fact, however, since the development characteristic at the highest potential area is saturated, the development density changes as shown by a broken line and thus the difference of the highest densities in the former and latter conditions is not remarkable. Therefore, the development densities of the duplicated copies in the former and latter conditions are substantially same.

With taking into account the above facts the development bias voltage adjusting dial 31 and the exposure adjusting dial 32 are so constructed that when these dials 31 and 32 are rotated together in one direction, the development bias voltage becomes low and an amount of exposure becomes low and when in the other direction, the development bias voltage becomes high and an amount of exposure becomes low. In practice, the optimum exposure is determined by adjusting any one of scale indications 40 provided on the exposure adjusting dial 32 (inner ring) to a center indication 41 provided on the development bias voltage adjusting dial 31 (outer ring) and if the density contrast of the duplicated copy is to be changed, both the inner and outer rings are simultaneously rotated while holding with fingers the dial 32 and a portion 31A of the dial 31, which portion has a diameter substantially equal to that of the dial 32 in either one of directions in accordance with an indication 42 provided on the panel 27 beside the outer ring 31. In the arrangement of FIG. 4, not only if a plurality of duplicated copies of a single and same original are formed by the electrophotographic apparatus of single exposure-multiple copy type, but also if they are formed by the electrophotographic apparatus of single exposure-single copy type, when it is desired to change only the development density it is only required to rotate the development bias voltage adjusting dial 31 constructed as the outer ring having a larger diameter than that of the inner ring 32.

As described above, according to the invention during the development step an operator can manually adjust the development bias voltage at will and thus the duplicated copy having a desired development density can be always obtained. Further, since the development bias voltage adjusting means and the exposure adjusting means are provided in manually operable manner, the half tone property and the development density can be controlled by operating these means.

Therefore, in case of forming a plurality of copies from the same original document by means of the electrophotographic apparatus of single exposure-multiple copy type and the electrophotographic apparatus of single exposure-single copy when the development density and the half tone reproduction of the first duplicated copy is not correct, the development bias voltage can be adjusted so that the development density and the half tone reproduction of the subsequent duplicated copies are corrected.

The present invention is not limited to the embodiments described above, but many modifications may be conceived by those skilled in the art within the scope of the invention. For example, the charge retentive member for retaining an electrostatic latent image to be developed may consist of an electrostatic record paper or of a transfer member composed of an electrically conductive member and an insulating member applied thereon. In this case, the electrostatic charge latent image could be formed by corona ion flow with a photosensitive screen or TESI (Transfer of Electro-Static Image) method, etc. Further, the present invention may be applied partially or as a whole to an electrophotographic process or apparatus for converting an optical brightness information of an original to a latent image in the form of electrostatic charge image, polarization image or conductivity change image and to a recording method and apparatus for recording an information transmitted by an X ray or various particle rays, an ion beam, a direct application of voltage to electrode and the like.

What is claimed is:

1. An electrophotographic apparatus comprising a housing, an electrostatic charge retentive member, means for forming on the charge retentive member an electrostatic charge latent image, means for developing the electrostatic latent image while applying a development bias voltage to form a toner image, means for transferring the toner image to a record medium, means for successively repeating said development and transfer to form a plurality of duplicated copies from the electrostatic latent image formed on the electrostatic charge retentive member, means for adjusting the development bias voltage including a manually operable means accessible externally of the apparatus to enable the development bias voltage to be adjusted during the repeated development and transfer after the formation of the electrostatic charge latent image to change the density of the duplicated copies, while the electrostatic charge latent image once formed remains on the charge retentive member, and means for adjusting the amount of exposure light before the formation of the electrostatic latent image, said exposure amount adjusting means and said development bias voltage adjusting means being coupled to a common handling member such that, when said common handling member is operated in one direction, the exposure amount is decreased and the development bias voltage is decreased and, when said common handling member is operated in another direction, the exposure amount is increased and the development bias voltage is increased, said common handling member comprising a common dial rotatably arranged on said housing and said development bias voltage adjusting means comprising a variable resistor having a rotating axis coupled to said common dial by means of a rotating shaft secured to the common dial.

2. An electrophotographic apparatus according to claim 1, wherein said exposure amount adjusting means comprises an exposure adjusting lever secured to said rotating shaft.

* * * * *